US006774272B2

(12) United States Patent
Miller

(10) Patent No.: US 6,774,272 B2
(45) **Date of Patent: *Aug. 10, 2004**

(54) PROCESS FOR CONVERTING HEAVY FISCHER TROPSCH WAXY FEEDS BLENDED WITH A WASTE PLASTIC FEEDSTREAM INTO HIGH VI LUBE OILS

(75) Inventor: Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/126,830

(22) Filed: Apr. 18, 2002

(65) Prior Publication Data

US 2003/0199717 A1 Oct. 23, 2003

(51) Int. Cl.[7] ..... C10G 57/00

(52) U.S. Cl. ..... 585/241; 208/18; 208/27; 208/67

(58) Field of Search ..... 208/18, 27, 67, 208/990, 19, 20; 585/241; 518/700

(56) References Cited

U.S. PATENT DOCUMENTS

| | | | | |
|---|---|---|---|---|
| 3,845,157 | A | | 10/1974 | Woo et al. |
| 3,852,207 | A | | 12/1974 | Stangeland et al. |
| 3,904,513 | A | | 9/1975 | Fischer et al. |
| 3,997,624 | A | * | 12/1976 | Hudgin ..... 260/683.15 |
| 4,042,488 | A | | 8/1977 | Perciful |
| 4,053,534 | A | | 10/1977 | Mitchell et al. |
| 4,157,294 | A | | 6/1979 | Iwao et al. |
| 4,482,752 | A | | 11/1984 | Mitchell et al. |
| 4,579,986 | A | | 4/1986 | Sie |
| 4,642,401 | A | | 2/1987 | Coenen et al. |
| 4,673,487 | A | | 6/1987 | Miller |
| 4,921,594 | A | | 5/1990 | Miller |
| 5,105,049 | A | | 4/1992 | Hasselbring |
| 5,118,902 | A | | 6/1992 | Drake |
| 5,135,638 | A | | 8/1992 | Miller |
| 5,246,566 | A | | 9/1993 | Miller |
| 5,282,958 | A | | 2/1994 | Santilli et al. |
| 5,378,348 | A | | 1/1995 | Davis et al. |
| 5,849,964 | A | | 12/1998 | Holighaus et al. |
| 6,143,940 | A | | 11/2000 | Miller et al. |
| 6,150,577 | A | | 11/2000 | Miller et al. |
| 6,288,296 | B1 | | 9/2001 | Miller et al. |
| 6,475,960 | B1 | * | 11/2002 | Berlowitz et al. ..... 508/110 |
| 6,497,812 | B1 | * | 12/2002 | Schinski ..... 208/131 |
| 2003/0199718 | A1 | * | 10/2003 | Miller ..... 585/241 |

FOREIGN PATENT DOCUMENTS

| | | |
|---|---|---|
| EP | 0 577 279 A1 | 1/1994 |
| EP | 0 620 264 A2 | 10/1994 |
| EP | 0 921 184 A1 | 6/1998 |
| GB | 742267 | 12/1955 |

OTHER PUBLICATIONS

Search Report issued in British Application No. GB 0309105.5, Sep. 18, 2003.

* cited by examiner

*Primary Examiner*—Walter D. Griffin
*Assistant Examiner*—James Arnold, Jr.
(74) *Attorney, Agent, or Firm*—Burns, Doane, Swecker & Mathis, L.L.P.

(57) ABSTRACT

A process for converting a blend of plastic waste and a Fischer-Tropsch waxy fraction into high VI lube oils. A Fischer-Tropsch wax is separated into a 1000° F.+ fraction and a 1000° F.− fraction. The higher boiling fraction is combined with virgin or waste polyolefin and fed to a pyrolysis zone after being heated in a heating unit. The pyrolysis effluent is separated into at least a heavy fraction. Any light fraction recovered can be further processed into a feed for gasoline products. Any middle fraction recovered can be hydrotreated and isodewaxed to form diesel, diesel blending and jet fuel, or can be oligomerized, hydrotreated and isodewaxed to form high VI lubricating base oil. The heavy fraction is hydrotreated and isodewaxed to yield high VI lubricating base oil. The process can be conducted on a continuous basis.

24 Claims, 2 Drawing Sheets

PROCESS FOR CONVERTING HEAVY FISCHER TROPSCH WAXY FEEDS BLENDED WITH A WASTE PLASTIC FEEDSTREAM INTO HIGH VI LUBE OILS

CROSS REFERENCE TO RELATED APPLICATIONS

The present application is related to application Ser. No. 10/126,831, filed concurrently herewith, entitled PROCESS FOR CONVERTING WASTE PLASTIC INTO LUBRICATING OILS.

BACKGROUND OF THE INVENTION

1. Field of the Invention

The present invention relates to a process of utilizing waste polymer material to manufacture useful products and more particularly to an improved process for making lubricating base oils from blends of waste plastics and Fischer-Tropsch waxes.

2. Description of Related Art

There is a steadily increasing demand for technology capable of converting discarded and waste plastic materials into useful products. This is due in large part to public concerns over potential environmental damage caused by the presence of these waste materials. According to a recent report from the EPA Office of Solid Waste, about 62% of all plastic packaging in the United States is composed of polyethylene, the preferred feed for plastics converted to lube oils. Plastics waste is the fastest growing waste product, with about 18 million tons per year in 1995 compared to only four million tons per year in 1970, and this amount is growing by approximately 10% per year. Transforming plastic waste material and particularly polyethylene into useful products presents a unique opportunity to address a growing environmental problem.

Because of environmental concerns, the specifications for fuels, lubricants and other petroleum products have become more stringent. This in turn has lead to a greater demand for lighter and cleaner petroleum feedstocks with the result that supplies of these feedstocks have been dwindling. In response to this, the production of synthetic lubricating oils from Fischer-Tropsch synthesized hydrocarbons has received increased attention, particularly in view of the relatively large amounts of natural gas reserves and the desire to convert these into more valuable products such as paraffinic lubricating oils. Accordingly, it would be advantageous to devise an economical process which converts waste plastic such as polyethylene into high viscosity index (VI) lube oils.

Processes are known which convert plastic waste into hydrocarbon oils. For example, U.S. Pat. No. 3,845,157 discloses cracking of waste or virgin polyolefins to form gaseous products such as ethylene/olefin copolymers which are further processed to produce synthetic hydrocarbon lubricants. U.S. Pat. No. 4,642,401 discloses the production of liquid hydrocarbons by heating pulverized polyolefin waste at temperatures of 150–500° C. and pressures of 20–300 bars. U.S. Pat. No. 5,849,964 discloses a process in which waste plastic materials are depolymerized into a volatile phase and a liquid phase. The volatile phase is separated into a gaseous phase and a condensate. The liquid phase, the condensate and the gaseous phase are refined into liquid-fuel components using standard refining techniques. U.S. Pat. No. 6,143,940 teaches a process of converting waste plastics into high yields of heavy waxes. U.S. Pat. No. 6,150,577 discloses a process of converting waste plastics into lubricating oils. EP0620264 discloses a process for producing lubricating oils from waste or virgin polyolefins by thermally cracking the waste in a fluidized bed to form a waxy product, optionally using a hydrotreatment, then catalytically isomerizing and fractionating to recover a lubricating oil.

One drawback to any process which converts plastic waste into useful products is the fact that, as with any recycle feed, the quality and consistency of the starting material is an important factor in obtaining quality end products. Recycled waste plastic not only is quite variable in consistency but its quality varies from one extreme to the other due to the many grades and types of plastics on the market. Another key factor is the importance of having a constant and continuous supply to make the process economical particularly when using off-specification waste obtained from polyolefin processing plants (so-called "virgin" polyolefin). A process which economically and efficiently converts plastic waste into high VI lube oils while maintaining control over the quality and quantity of the waste plastic supply and insuring the quality of the end products would be highly desirable.

Therefore, an object of the present invention is to provide an economic and efficient process for converting plastic waste into high VI lube oils.

Another object of the invention is to improve the quality of waste plastic pyrolysis feeds and the quality of the end product.

Still another objective of the invention is to develop an improved process which pyrolyzes plastic waste in combination with Fischer-Tropsch waxy feeds to upgrade the quality of the resultant products.

These and other objects of the present invention will become apparent to the skilled artisan upon a review of the following description, the claims appended thereto and the Figures of the drawings.

SUMMARY OF THE INVENTION

The objectives and advantages of the present invention are attained by a process which comprises the steps of blending a wax derived from a Fischer-Tropsch process with a waste and/or virgin polyolefin, passing the combined stream to a heating unit which liquefies the blend and maintains it at a temperature below that at which any significant depolymerization or decomposition would occur, passing the liquefied blend to a pyrolysis reactor maintained at a temperature sufficient to effect depolymerization, passing the effluent from the pyrolysis reactor to a fractionator, recovering at least a heavy liquid fraction, passing the heavy liquid fraction to a catalytic isomerization dewaxing unit (IDW) and recovering a lubricating base oil. A preferred wax derived from a Fischer-Tropsch process for blending with the waste and/or virgin polyolefin includes a 1000° F.+ Fischer-Tropsch wax fraction. If desired, the process can be conducted on a continuous basis.

Light fractions recovered from the pyrolysis effluent can be further processed and used as a feed for gasoline production. The light fraction can also be oligomerized to diesel and/or lube. Any middle fraction recovered also can be isomerization dewaxed and fractionated to recover diesel fuel, jet fuel and diesel blending stock. Alternatively, the middle fraction may be passed to a oligomerization reactor, followed by isomerization dewaxing and fractionation to recover high VI lubricating base oil. Any or all of the heavy liquid fraction, the light fraction and/or the middle fraction may be hydrotreated prior to the isomerization dewaxing step. The hydrotreating step is expected to remove nitrogen, oxygen and sulfur-containing contaminants, thereby, in certain cases, improving the effectiveness of the isomerization dewaxing process.

Preferably, the heavy liquid fraction obtained from fractionation of the pyrolysis effluent is blended with a heavy liquid fraction from a Fischer-Tropsch process, preferably including both a 1000° F.– fraction and/or a 1000° F.+ fraction, the blend thereafter subjected to a catalytic isomerization dewaxing, and fractionated to recover a high VI lube oil and a bright stock (i.e. a lubricating oil hydrocarbon in which about 50 wt % boils over 1000° F.).

In a separate embodiment, the feed to the pyrolysis reactor is a wax derived from a Fischer-Tropsch process. In this embodiment, a process for preparing a lubricating base oil comprises passing a wax derived from a Fischer-Tropsch process to a heating unit maintained at a temperature below the decomposition temperature of the wax; feeding the heated wax to a pyrolysis unit; pyrolyzing the wax to depolymerize at least a portion of the wax and recovering an effluent from the pyrolysis unit; processing the effluent in a separator to form at least a heavy liquid fraction; and, treating the heavy liquid fraction to produce a lubricating base oil.

Among other factors, the present invention is based upon the discovery that waste polyolefin can be economically and efficiently converted to high quality lubricating base oils by blending the waste with a Fischer-Tropsch heavy wax fraction, pyrolyzing the heated blend in a reactor, and subsequently hydrotreating and isomerization dewaxing a fraction obtained from the pyrolysis reactor. Using a Fischer-Tropsch fraction to supplement the polyolefin waste feed has eliminated the adverse impact on end-product quality caused by variations in the quality and consistency of the waste polyolefin used in the feed. When using virgin polyolefin as the waste polymer in the feed, the addition of a Fischer-Tropsch wax fraction obviates economical problems caused by variations in the cost and supply of polymer from industrial sites. Conducting the process on a continuous basis likewise contributes to economy and efficiency since smaller reactors can be employed and productivity increased.

DESCRIPTION OF PREFERRED EMBODIMENTS

Figure 1:
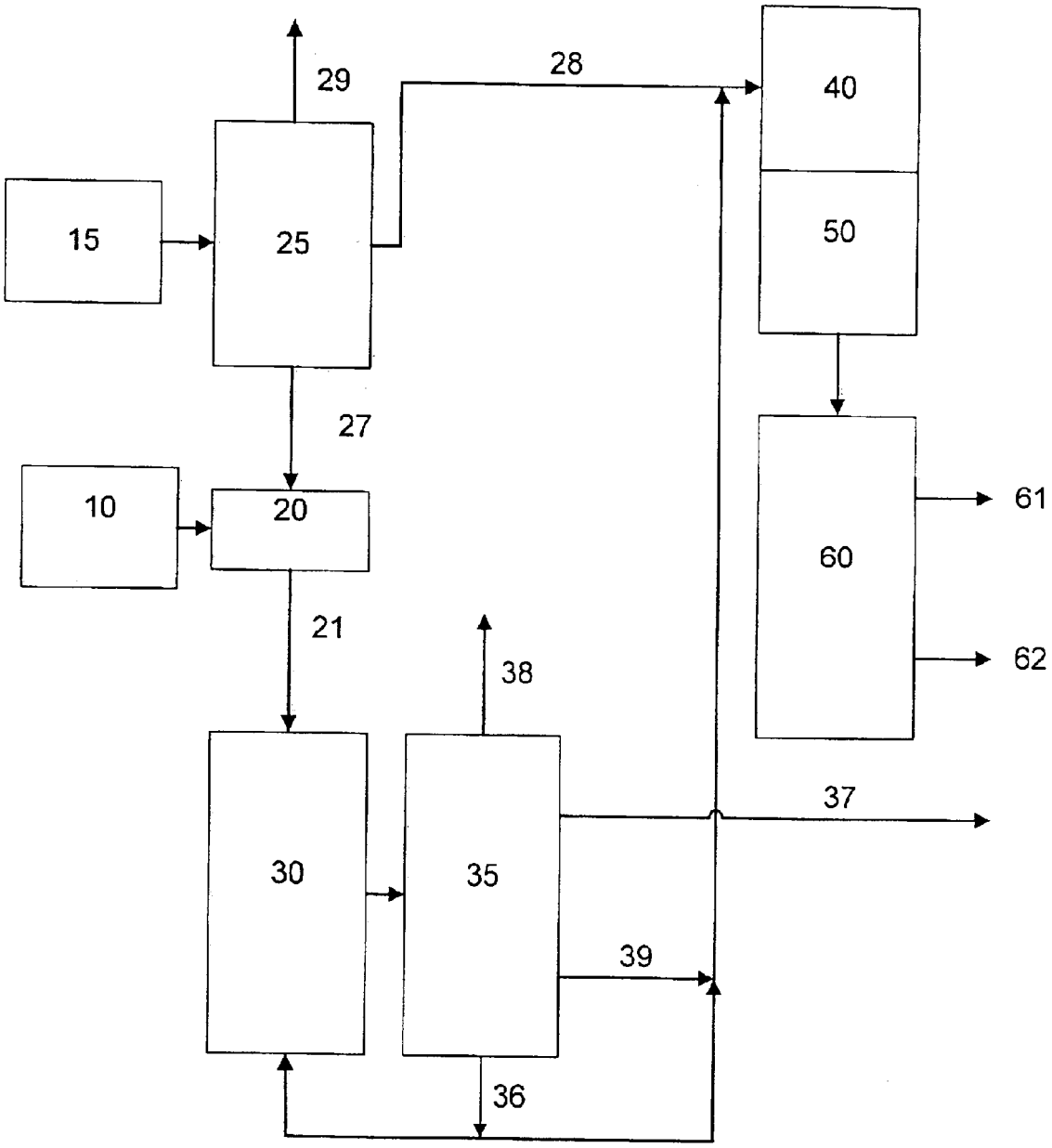
FIG. 1 is a schematic flow diagram of one embodiment of the invention.

In the Fischer-Tropsch synthesis, a synthetic gas composed mainly of CO and $H_2$, made for example, from natural gas, is converted in the presence of a catalyst into a wide range of gaseous and liquid hydrocarbons and a normally solid paraffinic wax. Catalysts and conditions for performing Fischer-Tropsch reactions are well known to those of skill in the art, and are described, for example, in EP0 921 184A1, the contents of which are hereby incorporated by reference in their entirety.

The paraffinic wax produced in the Fischer-Tropsch process is a $C_5$+ product, generally with an initial boiling point in the range of 600°–750° F. In practicing the process of the present invention, it is desirable to separate the paraffinic wax into at least two fractions. While the cutpoint between the two fractions depends on the particularly process, a preferred cutpoint is in the range of 950°–1150° F. The at least two wax fractions which are recovered from the separation are identified herein as a light wax fraction and a heavy wax fraction. The heavy wax fraction will hereinafter be referred to as the Fischer-Tropsch waxy feed. It is the latter which is employed in the present invention for purposes of blending with a waste or virgin polymer material, preferably polyolefin, and most preferably polyethylene.

The polyolefin material which is blended with the Fischer-Tropsch heavy wax fraction can be a waste recycled product or an off-specification virgin material obtained from a polyolefin industrial processing plant or a mixture of both. Suitable polyolefins include high density and low density polyethylene, polypropylene, EPDM elastomers, and the like. Polyethylenes, being the most prevalent waste and virgin plastics, are particularly suitable. The waste plastic can be processed before pyrolyzing to remove metals, paper and other extraneous material. Removing this extraneous material after pyrolyzing will be facilitated by the lower viscosity and lower melting point of the pyrolyzed effluent. The plastic material may be in solid form or admixed with an organic solvent to form a liquid mixture which is employed in preparing the feed to the pyrolysis unit. The polyolefin feed is initially passed to a heating unit normally maintained at a temperature of about 150° C.–350° C., preferably 200° C.–350° C., such that the feed is maintained below the temperature at which significant decomposition or depolymerization can occur. Normally, less than 5 wt. % of the feed would be thermally depolymerized to 1000° F.– material at this temperature. An inert gas such as nitrogen or argon can be used to blanket the feed while in the heater unit to minimize oxidation and prevent the formation of oxygenates which would have an adverse impact on the downstream catalysts and the quality of the end products.

At some point before the polyolefin feed is passed to the pyrolysis reactor, the heavy Fischer-Tropsch wax fraction is blended therewith. The Fischer-Tropsch wax may be added to the polyolefin feed before it enters the heating unit or, less preferably, after the feed leaves the heating unit on its way to the reactor. The Fischer-Tropsch wax and polyolefin waste may be passed to the heating unit in separate streams. The polyolefin/Fischer-Tropsch wax blend should be in a liquefied heated condition before entering the pyrolysis reactor.

Pyrolysis conditions employed include temperatures ranging from about 450° C. to about 700° C., preferably between about 500° C. and about 650° C., at pressures of less than about 15 bar, preferably in the range of about 1 bar to about 15 bar, and feed rates ranging from about 0.5 to about 5 $hr^{-1}$ LHSV. If desired, the polyolefin/Fischer-Tropsch wax blend can be continuously processed using a flow-through pyrolysis reactor as disclosed in the aforementioned related application, Ser. No. 10/126,831, the contents of which are incorporated herein in their entirety. An advantage of a continuous process is the increased throughput in the reactor and the fact that smaller reactors can be employed.

The effluent from the pyrolysis unit is then passed to a fractionator. Preferably, the 1000° F.– lighter fraction obtained by distilling the Fischer-Tropsch wax is added to the pyrolysis effluent stream before passing to the fractionator. The effluent stream is fractionated into at least three fractions, a light fraction, a middle fraction and a heavy liquid fraction. The light fraction is further processed using known technology into a feed for gasoline production. The middle fraction can be passed to a hydrotreatment unit which removes nitrogen-containing, sulfur-containing and oxygen-containing contaminants in known manner. The product from the hydrotreating unit is then passed to a catalytic isomerization dewaxing unit (IDW) where the product is processed in known manner. The catalytically isomerized product may further be hydrofinished to stabilize the product to oxidation and color formation. The finished effluent is then fractionated to form a diesel fuel, a diesel fuel blending stock and/or a jet fuel. Alternatively, the middle fraction can be passed to a oligomerization unit to be processed in a known manner. The effluent from the oligomerization unit can be catalytically isodewaxed in known manner if the pour point of the oligomers is too high (i.e. greater than 0° C.), and the product further hydrofinished. The heavy fraction is preferably passed to a hydrotreatment unit, then to an isomerization dewaxing unit, and further to a hydrofinishing unit, and the product therefrom fractionated to obtain a high VI lubricating base oil. As used herein, a lubricating base oil or lube base oil refers to a hydrocarbonaceous material boiling generally above about 650° F., with a viscosity at 100° C. of at least 2.2 cSt, and a pour point of no more than about 0° C.

In a separate embodiment, the pyrolysis effluent stream is fractionated, and a 650° F.– fraction and a 650° F.+ fraction recovered. In this embodiment, the 650° F.– fraction may be oligomerized to form additional high VI lubricating base oil. Suitable oligomerization processes are well known in the art. The 650° F.+ fraction is processed as described above, through isomerization dewaxing, with an optional hydrotreatment pretreatment step.

During oligomerization, an olefinic feedstock is contacted with a oligomerization catalyst in a oligomerization zone. Fluid-bed reactors, catalytic distillation reactors, and fixed bed reactors, such as that found in an MTBE or TAME plant, are suitably used as oligomerization reaction zones. Conditions for this reaction in the oligomerization zone are between room temperature and 400° F., preferably between 90 and 275° F., from 0.1 to 3 LHSV, and from 0 to 500 psig, preferably between 50 and 150 psig. Oligomerization catalysts for can be virtually any acidic material including zeolites, clays, resins, $BF_3$ complexes, HF, $H_2SO_4$, $AlCl_3$, ionic liquids (preferably acidic ionic liquids), superacids, etc. The preferred catalyst includes a Group VIII metal on an inorganic oxide support, more preferably a Group VIII metal on a zeolite support. Zeolites are preferred because of their resistance to fouling and ease of regeneration. The most preferred catalyst is nickel on ZSM-5. Catalysts and conditions for the oligomerization of olefins are well known, and disclosed, for example, in U.S. Pat. Nos. 4,053,534; 4,482,752; 5,105,049 and 5,118,902, the disclosures of which are incorporated herein by reference for all purposes.

As set forth above, processing conditions which are employed in the hydrotreatment (HT) unit are those conventionally employed in the art. Typical conditions include temperatures ranging from about 190° C. to about 340° C., pressures ranging from about 400–3,000 psig, space velocities (LHSV) from about 0.1 to about 20 $hr^{-1}$, and $H_2$ recycle rates ranging from about 400–15,000 SCF/bbl. U.S. Patents which disclose suitable hydrotreatment conditions and catalysts used therein include U.S. Pat. Nos. 5,378,348; 4,673,487; and 4,921,594, the disclosures of which are incorporated herein by reference.

The processing conditions which are employed in the catalytic isomerization dewaxing unit (IDW) likewise are those conventionally employed in the art. Preferably, the catalyst employed contains a intermediate pore size molecular sieve SAPO such as SAPO-11, SAPO-31, SAPO-41 or SM-3. Reference to suitable isomerization dewaxing conditions may be found in U.S. Pat. Nos. 5,135,638; 5,246,566; and 5,282,958, the disclosures all of which are incorporated herein in their entirety. Typical reaction conditions in the IDW unit include temperatures ranging from about 200° C. to about 475° C., pressures ranging from about 15 psig to about 3000 psig, a liquid hourly space velocity (LHSV) ranging from about 0.1 $hr^{-1}$ to about 20 $hr^{-1}$, preferably between about 0.2 $hr^{-1}$ to about 10 $hr^{-1}$ and a hydrogen recycle between about 500 to about 30,000 SCF/B, preferably between about 1000 to about 20,000 SCF/B. As is known in the art, isomerization catalytic dewaxing converts n-paraffins into iso-paraffins, thereby reducing the pour point of the resultant oils to form a high VI lube oil at a much higher yield.

The lubricating base oil which is prepared according to the present invention may be hydrofinished following the catalytic isomerization step. Hydrofinishing is typically conducted at temperatures ranging from about 190° C. to about 340° C., at pressures from about 400 psig to about 3000 psig, at space velocities (LHSV) from about 0.1 to about 20, and hydrogen recycle rates of from about 400 to about 1500 SCF/bbl. The hydrogenation catalyst employed must be active enough not only to hydrogenate the olefins, diolefins and color bodies within the lube oil fractions, but also to reduce the aromatic content (color bodies). The hydrofinishing step is beneficial in preparing an acceptably stable lubricating oil. Suitable hydrogenation catalysts include conventional metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly preferred hydrogenation metal. If desired, non-noble Group VIII metals can be used with molybdates. Metal oxides or sulfides can be used. Suitable catalysts are disclosed in U.S. Pat. Nos. 3,852,207; 4,157,294; 3,904,513 and 4,673,487, which are incorporated herein by reference.

With reference to FIG. 1, one embodiment of the process of the present invention is illustrated. A Fischer-Tropsch derived feed (15) is fed to a separation unit (25). The heavy wax fraction (27) is forwarded to a heater unit (20), a 650–1050° F. fraction (28) is passed to hydrotreating unit (40) and a 650° F.– fraction (29) recovered for use as a fuel or fuel blending component. A waste polyolefin feed 10 is passed to the heater (20). The waste polymer/Fischer-Tropsch wax feed blend (21) is forwarded to a pyrolysis reactor (30). The pyrolysis effluent is then forwarded to a fractionator (35). A portion of heavier bottoms (36) from the fractionator may be circulated back to the pyrolysis reactor. A light 390–650° F. fraction (37) is drawn off and further processed to produce a fuel, as is 390° F.– stream (38). The middle fraction (39) is circulated to a hydrotreating unit (40) and the product passed to an IDW unit (50). At least a portion of heavy portion (36) may also be combined with middle fraction (39) for hydrotreating (40) and isomerization dewaxing in IDW unit (50). The product from the IDW unit is then passed to a fractionator (60) where the various products are drawn off as a diesel fraction (61), and a lube oil fraction (62).

Figure 2:
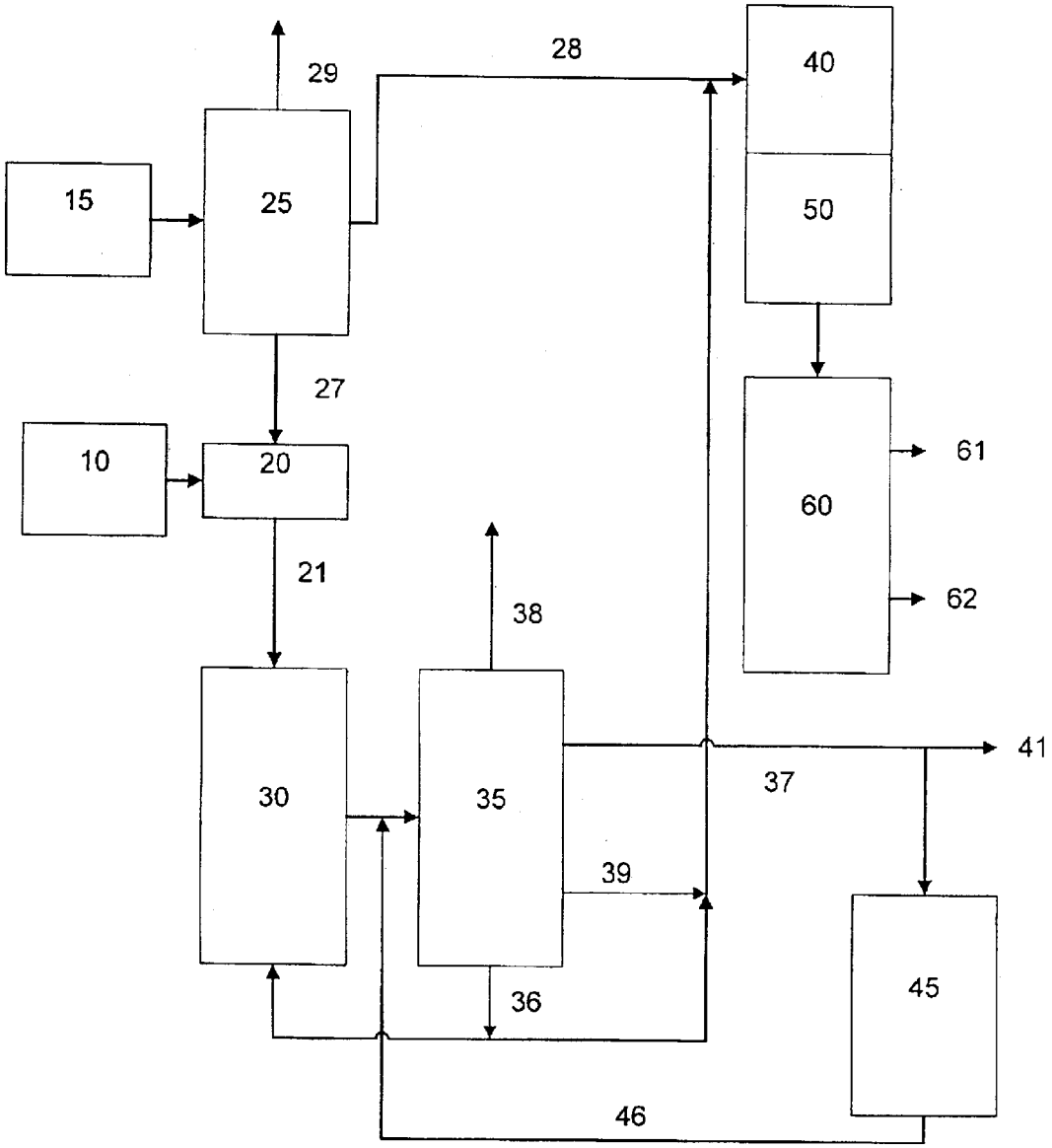
FIG. 2 is a schematic flow diagram of a second embodiment of the invention.

FIG. 2 discloses a similar process to that exemplified in FIG. 1, except for the presence of a oligomerization reactor 45. As shown, the Fischer-Tropsch heavy wax stream (27) and the waste polymer stream (10) are passed to the heater (20) and the heated blend passed to pyrolysis reactor (30).

The reactor effluent is passed to fractionator (35). The bottoms (36) from the fractionator may be recirculated to the pyrolysis reactor. The medium (650°–1050° F.) liquid fraction (39), with at least a portion of 1050° F.+ bottoms (36), are admixed with a 650°–1050° F. liquid fraction (28) from separator (25) and the admixture hydrotreated, isodewaxed and fractionated. The lighter 390°–650° F. fraction (37) is passed to oligomerization reactor (45) and the effluent therefrom (46) to fractionator (35). A portion of stream (37) may be withdrawn (41) to remove excess unconverted paraffins from the feed to the oligomerization unit. Alternatively, a 390–650° F. fraction may be removed from (46) using a separate fractionator for the oligomerization unit (separation not shown).

The invention will now be illustrated by the following examples which are intended to be merely exemplary and in no manner limiting.

EXAMPLE 1

High density polyethylene (HDPE), obtained from Chevron Chemical Company, was mixed 50/50 by weight with a 550–700° F. hydrocracked diesel. This was put into a 7.5 gallon stainless steel feed pot with a stirrer, and heated under 10 psi nitrogen to 500° F. to melt the plastic and lower the viscosity of the plastic/diesel feed to a point at which it could then be easily pumped. The feed was then pumped upflow, using a gear pump, through a stainless steel reactor containing steel bars to lower the reactor volume to 140 cc. Reactor conditions included a temperature of 975° F., atmospheric pressure, and a residence time of approximately one hour. Products were collected and analyzed.

Table I shows the yields and inspections from the pyrolysis run. The yield of 725° F.+ product, with an endpoint of about 1100° F., suitable for lubricating base oil, was 51.4 wt % based on plastic in the feed. The liquid bottoms collected from that run were then isomerized over a Pt/SAPO-11 catalyst at 500 psig, 600° F., 0.65 LHSV, and 5 MSCF/bbl $H_2$ (followed by a $Pt/SiO_2$-$Al_2O_3$ hydrofinishing catalyst at 450° F. and 1.3 LHSV) to produce a −37° C. pour point 5.4 cSt oil of 156 VI (Table II). The overall 725° F.+ yield, based on plastic to the pyrolyzer, was 21.3 wt %

EXAMPLE 2

Example 1 was repeated, except the plastic was 96 wt % HDPE and 4 wt % waste polyethylene terephthalate. An online stripper separated most of the 600° F.− product from the higher boiling bottoms product. Pyrolysis yields are given in Table III, showing a 725° F.+ yield, based on plastic, of 42.4 wt %. Table IV gives yields and inspections for isomerization of the pyrolysis bottoms over the same Pt/SAPO-11 catalyst as in Example 1, and the same run conditions except for an isomerization temperature of 675° F. This gave a −13° C. pour point 4.9 cSt oil of 160 VI. The overall 725° F.+ yield, based on plastic to the pyrolyzer, was 25.3 wt %. Since the pyrolysis overhead gas and liquid were highly olefinic, oligomerization of these olefins could produce additional low pour point lube base oil.

EXAMPLE 3

A portion of the pyrolysis bottoms made in Example 2 was hydrotreated over a Ni—W/SiO2—Al2O3 catalyst at 600° F., 1.5 LHSV, 1950 psig, and 5 MSCF/bbl $H_2$ to reduce heteroatom content in the feed. At these conditions, cracking of the feed was very low. The hydrotreated feed was then isomerized over the same Pt/SAPO-11 catalyst as in Example I, and the same conditions, except for an isomerization temperature of 670° F. and pressure of 1950 psig. This gave a −34° C. pour point 3.0 cSt oil of 131 VI (Table V). The overall 725° F.+ yield, based on plastic to the pyrolyzer, was 17.2 wt %. It is believed the yield and VI would have been higher had the oil been run to a higher pour point, and distilled to the same viscosity as in Example 2.

EXAMPLE 4

The pyrolysis run of Example 1 was repeated (Table VI) at the same conditions, but this time on a feed composed of a 50/50 mixture by weight of low density polyethylene (LDPE), obtained from Chevron Chemical Company, and a hydrotreated Fischer-Tropsch wax, obtained from Moore & Munger (Table VII). Yields are given in Table VI, showing a 725° F.+ yield of 57.5 wt %. The yield for a broader lube feed, 650° F.+, was 66.0 wt %. While there was considerable 1000° F.+ in the feed to the pyrolyzer, there was little 1000° F.+ in the product, which is believed here to be advantageous for low cloud point. The pyrolysis bottoms were then isomerized over the same Pt/SAPO-11 catalyst as in Example 1, and at the same conditions, except for an isomerization temperature of 687° F., to give a −22° C. pour point 4.4 cSt oil of 154 VI (Table VIII). The overall 725° F.+ yield, based on feed to the pyrolyzer, was 34.8 wt %. For overall 650° F.+, the yield was 43.7 wt %. Adding the potential lube from oligomerizing the lighter olefinic product from the pyrolyzer would increase these yields still further.

Table VII lists properties of four feed (A=Diesel Diluent: B=Moore & Munger FT Wax: C=hydrotreated heavy (i.e. bottoms) fraction from pyrolyzed HDPE/PET/Diesel: D=hydrotreated heavy (i.e. bottoms) fraction from pyrolyzed LDPE/FT Wax).

EXAMPLE 5

A portion of the pyrolysis bottoms from Example 4 was hydrotreated over the Ni—W/SiO2-Al2O3 catalyst as in Example 3. This was then isomerized as in Example 4, except for a isomerization temperature of 640° F. This gave a −15° C. pour point 3.8 cSt oil with a 150 VI (Table IX). The overall 725° F.+ yield, based on feed to the pyrolyzer, was 31.2 wt %. For overall 650° F.+, the yield was 39.7 wt %.

EXAMPLE 6

FT wax was run without plastic. Yields through the pyrolyzer are given in Table X, showing a surprisingly similar product distribution and olefinicity to the run with a 50/50 LDPE/FT wax mix. Again, there was little 1000° F.+ in the product, which was mostly in the neutral oil boiling range. Isomerization of the pyrolysis bottoms at 637° F. gave a −14° C. pour 3.4 cSt oil of 150 VI (Table XI). The overall 650° F.+yield was about 37 wt %. Adding the potential lube from oligomerizing the lighter olefinic product from the pyrolyzer would increase the 650° F.+ yield to about 52 wt %. Had all the 650° F.− from the pyrolyzer been sent to the oligomerizer, the potential 650° F.+ would be about 62 wt %). It's also worth noting that the cloud point for the oil made from FT wax was below 0° C. This would not be expected for isomerization of the starting wax feed, except possibly at very low pour point, and at a substantial yield penalty.

EXAMPLE 7

HDPE beads were admixed with diesel oil to form a 50/50 by weight feed. The feed was pumped to a heating unit maintained at a temperature of 500° F. The feed was blanketed with nitrogen to minimize oxidation. The heated feed was then continuously pumped upward through a pyrolysis reactor equipped with preheat bars to maintain a reaction temperature of 1025° F. and atmospheric pressure. Residence time for the feed was 1 hour. The pyrolyzed product was stripped at a temperature of about 550° F. with the overhead and bottoms liquids collected separately. The bottoms, which were quite light in color, were forwarded to an IDW unit. Isomerization dewaxing was performed under the following conditions: 675° F., 0.5 LHSV, 1950 psig, and 3.6 MSCF/BBL of once-through H2. The product from the IDW unit was fractionated. Analysis of the yield and composition thereof is set forth in Table XII.

TABLE I

Pyrolysis of 50/50 by Weight Plastic/Diesel at 975° F., Atmospheric Pressure, and 1 Hr Residence Time
Plastic = HDPE

| | |
|---|---|
| Yield, Wt % | |
| C1 | 0.5 |
| C2= | 0.8 |
| C2 | 0.6 |
| C3= | 1.2 |
| C3 | 0.5 |
| C4= | 0.8 |
| C4 | 0.5 |
| C4– | 4.9 |
| C5-350° F. | 9.6 |
| 350–650° F. | 56.0 |
| 650–725° F. | 3.8 |
| 725° F.+ | 25.7 |
| 725° F.+, based on plastic | 51.4 |
| Bottoms | |
| Wt % of feed | 92.0 |
| Gravity, API | 42.7 |
| Sulfur, ppm | <1.5 |
| Nitrogen, ppm | 1.3 |
| Sim. Dist., ° F., Wt % | |
| ST/5 | 149/302 |
| 10/30 | 390/506 |
| 50 | 572 |
| 70/90 | 692/955 |
| 95/EP | 1011/1109 |

TABLE II

Isomerization Dewaxing of Pyrolyzed Product from HDPE/Diesel at 500 psig, 600° F., 0.65 LHSV, and 5 MSCF/bbl $H_2$

| | |
|---|---|
| Yield, Wt % | |
| C3 | 0.8 |
| C4 | 2.9 |
| C4– | 3.7 |
| C5-350° F. | 25.3 |
| 350–650° F. | 56.1 |
| 650–725° F. | 3.3 |
| 725° F.+ | 11.6 |
| 725° F.+, based on 725° F.+ to IDW | 41.1 |
| Overhead | |
| Wt % of Feed | 75.9 |
| Sim. Dist., ° F., Wt % | |
| ST/5 | 73/194 |
| 10/30 | 243/367 |
| 50 | 448 |
| 70/90 | 520/584 |
| 95/EP | 605/647 |

TABLE II-continued

Isomerization Dewaxing of Pyrolyzed Product from HDPE/Diesel at 500 psig, 600° F., 0.65 LHSV, and 5 MSCF/bbl $H_2$

| | |
|---|---|
| Bottoms | |
| Wt % of feed | 15.4 |
| Pour Point, ° C. | −37 |
| Cloud Point, ° C. | +9 |
| Viscosity, 40° C., cSt | 25.43 |
| 100° C., cSt | 5.416 |
| VI | 156 |
| Sim. Dist., ° F., Wt % | |
| ST/5 | 621/655 |
| 10/30 | 674/745 |
| 50 | 844 |
| 70/90 | 925/1051 |
| 95/EP | 1094/1153 |
| Overall Wt % 725° F.+, based on plastic | 21.3 |

TABLE III

Pyrolysis of 50/50 by Weight Plastic/Diesel at 975° F., Atmospheric Pressure, and 1 Hr Residence Time
Plastic = 96 wt % HDPE/4 wt % PET

| | |
|---|---|
| Yield Wt % | |
| C1 | 0.2 |
| C2= | 0.5 |
| C2 | 0.4 |
| C3= | 0.6 |
| C3 | 0.4 |
| C4= | 0.6 |
| C4 | 0.2 |
| C4– | 2.9 |
| C5-350° F. | 15.6 |
| 350–650° F. | 52.7 |
| 650–725° F. | 7.6 |
| 725° F.+ | 21.2 |
| 725° F.+, based on plastic | 42.4 |
| Overhead | |
| Wt % of Feed | 56.2 |
| P + N/Olefins/Aromatics | 41.0/56.0/3.0 |
| Sim. Dist., ° F., Wt % | |
| ST/5 | 106/194 |
| 10/30 | 231/382 |
| 50 | 513 |
| 70/90 | 568/621 |
| 95/EP | 649/784 |
| Bottoms | |
| Wt % of feed | 39.5 |
| Gravity, API | 40.0 |
| Sulfur, ppm | 3.6 |
| Nitrogen, ppm | 6.1 |
| Sim. Dist., ° F., Wt % | |
| ST/5 | 458/525 |
| 10/30 | 555/629 |
| 50 | 732 |
| 70/90 | 821/911 |
| 95/EP | 944/995 |

TABLE IV

Isomerization Dewaxing of Pyrolyzed Product from HDPE/PET/Diesel at 500 psig, 675° F., 0.65 LHSV, and 5 MSCF/bbl $H_2$ (Hydrofinish at 450° F. and 1.3 LHSV)

| | |
|---|---|
| Yield, Wt % | |
| C3 | 0.5 |
| C4 | 1.4 |
| C4– | 1.9 |
| C5-350° F. | 7.4 |
| 350–650° F. | 46.3 |
| 650–725° F. | 13.4 |
| 725° F.+ | 31.0 |
| 725° F.+, based on 725° F.+ to IDW | 68.9 |
| Overhead | |
| Wt % of Feed | 56.9 |
| Sim. Dist., ° F., Wt % | |
| ST/5 | 156/288 |
| 10/30 | 368/538 |
| 50 | 582 |
| 70/90 | 613/650 |
| 95/EP | 665/694 |
| Bottoms | |
| Wt % of feed | 38.7 |
| Pour Point, ° C. | −13 |
| Cloud Point, ° C. | +6 |
| Viscosity, 40° C., cSt | 21.63 |
| 100° C., cSt | 4.920 |
| VI | 160 |
| Sim. Dist., ° F., Wt % | |
| ST/5 | 655/684 |
| 10/30 | 699/752 |
| 50 | 810 |
| 70/90 | 873/958 |
| 95/EP | 999/1085 |
| Overall Wt % 725° F.+, based on plastic | 25.3 |

TABLE V

Isomerization Dewaxing of Hydrotreated Pyrolyzed Product from HDPE/PET at 1950 psig, 670° F., 0.65 LHSV, and 5 MSCF/bbl $H_2$ (Hydrofinish at 450° F. and 1.3 LHSV)

| | |
|---|---|
| Yield, Wt % | |
| C1 | 0.1 |
| C2 | 0.2 |
| C3 | 2.7 |
| C4 | 6.2 |
| C4– | 9.2 |
| C5-350° F. | 22.3 |
| 350–650° F. | 41.7 |
| 650–725° F. | 6.0 |
| 725° F.+ | 20.8 |
| 725° F.+, based on 725° F.+ to IDW | 37.1 |
| Overhead | |
| Wt % of Feed | 40.3 |
| Sim. Dist., ° F., Wt % | |
| ST/5 | 72/152 |
| 10/30 | 193/297 |
| 50 | 395 |
| 70/90 | 505/553 |
| 95/EP | 569/598 |
| Bottoms | |
| Wt % of feed | 45.0 |
| Pour Point, ° C. | −34 |
| Cloud Point, ° C. | −3 |
| Viscosity, 40° C., cSt | 10.86 |

TABLE V-continued

Isomerization Dewaxing of Hydrotreated Pyrolyzed Product from HDPE/PET at 1950 psig, 670° F., 0.65 LHSV, and 5 MSCF/bbl $H_2$ (Hydrofinish at 450° F. and 1.3 LHSV)

| | |
|---|---|
| 100° C., cSt | 2.967 |
| VI | 131 |
| Sim. Dist., ° F., Wt % | |
| ST/5 | 510/565 |
| 10/30 | 587/642 |
| 50 | 710 |
| 70/90 | 793/899 |
| 95/EP | 941/1041 |
| Overall Wt % 725° F.+, based on plastic | 17.2 |

TABLE VI

Pyrolysis of 50/50 by Weight LDPE/FT Wax at 975° F., Atmospheric Pressure, and 1 Hr Residence Time

| | |
|---|---|
| Yield, Wt % | |
| C1 | 0.2 |
| C2= | 0.6 |
| C2 | 0.4 |
| C3= | 0.9 |
| C3 | 0.7 |
| C4= | 0.9 |
| C4 | 0.4 |
| C4– | 4.1 |
| C5-350° F. | 9.9 |
| 350–650° F. | 20.0 |
| 650–725° F. | 8.5 |
| 725° F.+ | 57.5 |
| Overhead | |
| Wt % of Feed | 17.1 |
| P + N/Olefins/Aromatics | 22.0/76.0/2.0 |
| Sim. Dist., ° F., Wt % | |
| ST/5 | 114/201 |
| 10/30 | 215/307 |
| 50 | 378 |
| 70/90 | 455/550 |
| 95/EP | 599/692 |
| Bottoms | |
| Wt % of feed | 76.0 |
| Gravity, API | 40.7 |
| Sulfur, ppm | <4 |
| Nitrogen, ppm | 7.9 |
| Sim. Dist., ° F., Wt % | |
| ST/5 | 460/580 |
| 10/30 | 633/757 |
| 50 | 850 |
| 70/90 | 910/979 |
| 95/EP | 1002/1051 |

TABLE VII

Feed Inspections

| Feed | A | B | C | D |
|---|---|---|---|---|
| Gravity, ° API | | 38.2 | 40.5 | 42.1 |
| Nitrogen, ppm | | 1.9 | | |
| Sim. Dist., ° F., Wt % | | | | |
| ST/5 | 505/533 | 791/856 | 255/518 | 118/544 |
| 10/30 | 553/621 | 876/942 | 553/648 | 598/744 |
| 50 | 670 | 995 | 753 | 842 |
| 70/90 | 699/719 | 1031/1085 | 840/928 | 914/985 |
| 95/EP | 725/735 | 1107/1133 | 964/1023 | 1011/1068 |

TABLE VIII

Isomerization Dewaxing of Pyrolyzed Product from 50/50 LDPE/FT Wax at 500 psig, 687° F., 0.65 LHSV, and 5 MSCF/bbl $H_2$ (Hydrofinish at 450° F. and 1.3 LHSV)

| | |
|---|---|
| Yield, Wt % | |
| C3 | 0.5 |
| C4 | 0.9 |
| C4– | 1.4 |
| C5-350° F. | 8.7 |
| 350–650° F. | 32.6 |
| 650–725° F. | 11.5 |
| 725° F.+ | 45.8 |
| Overhead | |
| Wt % of Feed | 34.9 |
| Sim. Dist., ° F., Wt % | |
| ST/5 | 157/246 |
| 10/30 | 292/430 |
| 50 | 512 |
| 70/90 | 569/611 |
| 95/EP | 621/641 |
| Bottoms | |
| Wt % of feed | 60.9 |
| Pour Point, ° C. | −22 |
| Cloud Point, ° C. | −2 |
| Viscosity, 40° C., cSt | 18.70 |
| 100° C., cSt | 4.416 |
| VI | 154 |
| Sim. Dist., ° F., Wt % | |
| ST/5 | 614/646 |
| 10/30 | 668/745 |
| 50 | 819 |
| 70/90 | 885/961 |
| 95/EP | 991/1088 |
| Overall Wt % 725° F.+, based on feed | 34.8 |
| Overall Wt % 650° F.+, based on feed | 43.7 |

TABLE IX

Isomerization Dewaxing of Hydrotreated Pyrolyzed Product from 50/50 LDPE/FT at 500 psig, 640° F., 0.65 LHSV, and 5 MSCF/bbl $H_2$ (Hydrofinish at 450° F. and 1.3 LHSV)

| | |
|---|---|
| Yield, Wt % | |
| C2 | 0.1 |
| C3 | 0.8 |
| C4 | 1.7 |
| C4– | 2.6 |
| C5-350° F. | 13.7 |
| 350–650° F. | 31.7 |
| 650–725° F. | 11.0 |
| 725° F.+ | 41.0 |
| Overhead | |
| Wt % of Feed | 31.9 |
| Sim. Dist., ° F., Wt % | |
| ST/5 | 81/190 |
| 10/30 | 238/344 |
| 50 | 438 |
| 70/90 | 508/565 |
| 95/EP | 586/682 |
| Bottoms | |
| Wt % of feed | 61.6 |
| Pour Point, ° C. | −15 |
| Cloud Point, ° C. | −2 |
| Viscosity, 40° C., cSt | 15.23 |
| 100° C., cSt | 3.829 |
| VI | 150 |

TABLE IX-continued

Isomerization Dewaxing of Hydrotreated Pyrolyzed Product from 50/50 LDPE/FT at 500 psig, 640° F., 0.65 LHSV, and 5 MSCF/bbl $H_2$ (Hydrofinish at 450° F. and 1.3 LHSV)

| | |
|---|---|
| Sim. Dist., ° F., Wt % | |
| ST/5 | 564/601 |
| 10/30 | 623/710 |
| 50 | 798 |
| 70/90 | 878/962 |
| 95/EP | 995/1067 |
| Overall Wt % 725° F.+, based on feed | 31.2 |
| Overall Wt % 650° F.+, based on feed | 39.7 |

TABLE X

Pyrolysis of FT Wax at 975° F., Atmospheric Pressure, and 1 Hr Residence Time

| | |
|---|---|
| Yield, Wt % | |
| C1 | 1.0 |
| C2= | 0.6 |
| C2 | 2.4 |
| C3= | 0.8 |
| C3 | 1.8 |
| C4= | 1.6 |
| C4 | 1.3 |
| C4– | 9.5 |
| C5-350° F. | 8.4 |
| 350–650° F. | 21.4 |
| 650–725° F. | 9.6 |
| 725° F.+ | 51.1 |
| Overhead | |
| Wt % of Feed | 17.6 |
| P + N/Olefins/Aromatics | 20.0/79.0/1.0 |
| Sim. Dist., ° F., Wt % | |
| ST/5 | 130.201 |
| 10/30 | 231/331 |
| 50 | 382 |
| 70/90 | 454/545 |
| 95/EP | 585/690 |
| Bottoms | |
| Wt % of feed | 71.8 |
| Gravity, API | 41.9 |
| Sulfur, ppm | <4 |
| Nitrogen, ppm | 2.2 |
| Sim. Dist., ° F., Wt % | |
| ST/5 | 454/575 |
| 10/30 | 621/732 |
| 50 | 824 |
| 70/90 | 896/970 |
| 95/EP | 999/1051 |

TABLE XI

Isomerization Dewaxing of Pyrolyzed Product from FT Wax at 500 psig, 637° F., 0.65 LHSV, and 5 MSCF/bbl $H_2$ (Hydrofinish at 450° F. and 1.3 LHSV)

| | |
|---|---|
| Yield, Wt % | |
| C3 | 0.5 |
| C4 | 1.0 |
| C4– | 1.5 |
| C5-350° F. | 10.2 |
| 350–650° F. | 37.4 |
| 650–725° F. | 12.4 |
| 725° F.+ | 38.5 |

TABLE XI-continued

| Isomerization Dewaxing of Pyrolyzed Product from FT Wax at 500 psig, 637° F., 0.65 LHSV, and 5 MSCF/bbl $H_2$ (Hydrofinish at 450° F. and 1.3 LHSV) | |
|---|---|
| Overhead | |
| Wt % of Feed | 31.8 |
| Sim. Dist., ° F., Wt % | |
| ST/5 | 99/196 |
| 10/30 | 243/370 |
| 50 | 463 |
| 70/90 | 525/558 |
| 95/EP | 568/591 |
| Bottoms | |
| Wt % of feed | 64.7 |
| Pour Point, ° C. | −14 |
| Cloud Point, ° C. | −1 |
| Viscosity, 40° C., cSt | 12.56 |
| 100° C., cSt | 3.380 |
| VI | 150 |
| Sim. Dist., ° F., Wt % | |
| ST/5 | 553/584 |
| 10/30 | 606/684 |
| 50 | 764 |
| 70/90 | 841/916 |
| 95/EP | 946/1010 |
| Overall Wt % 725° F.+, based on feed | 27.6 |
| Overall Wt % 650° F.+, based on feed | 36.5 |

TABLE XII

| Isomerization Dewaxing of Pyrolyzed Product from HDPE/Diesel at 675° F., 1950 psig, 0.5 LHSV, and 3.6 MSCF/bbl $H_2$ (Hydrofinish at 450° F. and 1.3 LHSV) | |
|---|---|
| C4− | 0.5 |
| C5, −180° F. | 2.3 |
| 180–300° F. | 3.7 |
| 300–725° F. | 73.5 |
| 725° F.+ | 20.00 |
| 725° F.+ Conversion | 27.5 |
| | wt. % |
| 725° F.+ Overhead | |
| Wt % of IDW Feed | 74.3 |
| St/5 | 175/287 |
| 10/30 | 361/531 |
| 50 | 601 |
| 70/90 | 661/707 |
| 95/EP | 720/759 |
| 725° F.+ Bottoms | |
| Wt % of IDW Feed | 19.4 |
| Wt % of Plastic Feed to Process | 26.7 |
| St/5 | 686/722 |
| 10/30 | 744/818 |
| 50 | 882 |
| 70/90 | 948/1028 |
| 95/EP | 1056/1110 |
| Pour Pt, ° C. | −9 |
| Cloud Pt. ° C. | +14 |
| Viscosity, 40° C., cSt | 34.35 |
| 100° C., cSt | 6.891 |
| VI | 165 |

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A process for preparing a lubricating base oil which comprises:

(a) combining a waste and/or virgin polyolefin and a wax derived from a Fischer-Tropsch process to form a blend;

(b) passing the blend to a heating unit maintained at a temperature of between about 150° C. and 350° C.;

(c) feeding the heated blend to a pyrolysis unit;

(d) pyrolyzing the blend to depolymerize at least a portion of the blend components and recovering an effluent from the pyrolysis unit;

(e) processing the effluent in a separator to form at least a heavy liquid fraction; and, (f) treating the heavy liquid fraction to produce a lubricating base oil.

2. A process according to claim 1, wherein the blend is composed of 5–95 wt. % of Fischer-Tropsch wax and 95–5 wt. % of waste and/or virgin plastic.

3. A process according to claim 1, wherein the polyolefin is a polyethylene.

4. A process according to claim 1, wherein the pyrolysis effluent is separated into at least a light fraction, a middle fraction and the heavy liquid fraction.

5. A process according to claim 1, further comprising processing the heavy liquid fraction in a catalytic isomerization dewaxing unit.

6. A process according to claim 1, wherein the catalyst in the isomerization dewaxing unit contains an intermediate pore size molecular sieve SAPO.

7. A process according to claim 1, which is conducted on a continuous basis.

8. A process according to claim 1, wherein the wax derived from a Fischer-Tropsch process is a 1000° F.+ waxy fraction.

9. A process according to claim 8, wherein said 1000° F.+ waxy fraction is obtained from the fractionation of a Fischer-Tropsch wax into a 1000° F.+ waxy fraction and a 1000° F.− fraction.

10. A process according to claim 9, wherein said 1000° F.− fraction is blended with the heavy liquid fraction recovered from the pyrolysis effluent and the blend forwarded to a catalytic isomerization dewaxing unit.

11. A process according to claim 4, wherein said light fraction is further processed into a feed for gasoline production.

12. A process according to claim 4, wherein said middle fraction is processed in a hydrotreatment unit, in an isomerization dewaxing unit and fractionated to recover fuels.

13. A process according to claim 4, wherein said middle fraction is circulated to an oligomerization reactor and the effluent therefrom processed in a hydrofinishing unit, and fractionated to recover a lubricating base oil.

14. A process for preparing a lubricating base oil comprising the steps of:

(a) fractionating a solid paraffinic wax obtained from a Fischer-Tropsch synthesis and recovering a 1000° F.− fraction and a 1000° F.+ wax fraction;

(b) blending a waste and/or virgin polyethylene and the Fischer-Tropsch 1000° F.+ wax fraction wherein the polyethylene and wax fraction are admixed in an amount ranging from about 5–95 wt. % of polyethylene and 95–5 wt. % of the wax fraction;

(c) heating the blend in a heating unit maintained at a temperature of about 150° C. to about 350° C.;

(d) passing the blend to a pyrolysis reactor maintained at a temperature of about 450° C. to about 700° C. and an absolute pressure of at least 1 bar;

(e) passing the effluent from the pyrolysis reactor to a separator;

(f) recovering at least a middle fraction and a heavy liquid fraction from the separator;

(g) admixing the heavy liquid fraction from the separator with the 1000° F.− fraction obtained in step (a) to form a liquid mixture;

(h) forwarding the liquid mixture from step (g) to a hydrotreating unit to remove substantially all nitrogen- and sulfur-containing contaminants therefrom;

(i) passing the effluent from the hydrotreating unit to a catalytic isomerization dewaxing unit;

(j) passing the effluent from the isomerization dewaxing unit to a fractionator; and (k) recovering a lubricating base oil.

15. A process according to claim 14, wherein the pyrolysis reactor is a flow-through unit and the heated blend is continuously circulated through the unit.

16. A process according to claim 14, wherein the catalytic isomerization dewaxing unit contains an intermediate pore size molecular sieve catalyst.

17. A process according to claim 14, wherein the middle fraction recovered from the pyrolysis effluent is passed to a hydrotreating unit, passed to a catalytic isomerization dewaxing unit, and the effluent from the isomerization dewaxing unit fractionated to recover a diesel fuel, a jet fuel and a diesel blending stock.

18. A process according to claim 14, where the middle fraction recovered from the pyrolysis effluent is passed to a oligomerization reactor, the effluent from the reactor passed to hydrotreating, then passed to a catalytic isomerization dewaxing unit and then fractionated to recover a lubricating base oil.

19. A process for preparing a lubricating base oil which comprises:

(a) recovering a heavy wax from a Fischer-Tropsch process;

(b) forwarding the wax, optionally blended with a waste and/or virgin polyolefin, to a heating unit maintained at a temperature sufficient to liquify the wax;

(c) feeding the heated wax to a pyrolysis unit;

(d) pyrolyzing the wax;

(e) recovering an effluent from the pyrolysis unit;

(f) processing the effluent in a separator to form at least a heavy liquid fraction; and, (g) treating the heavy liquid fraction to produce a lubricating base oil.

20. A process according to claim 19, further comprising processing said heavy liquid fraction in a catalytic isomerization dewaxing unit.

21. A process according to claim 19, further comprising processing at least a portion of the heavy liquid fraction in a catalytic isomerization dewaxing unit.

22. A process according to claim 21, wherein the isomerization dewaxing unit comprises an intermediate pore size molecular sieve SAPO catalyst.

23. A process according to claim 19, which is conducted on a continuous basis.

24. A process according to claim 19, wherein the wax derived from a Fischer-Tropsch process is a 1000° F.+ waxy fraction.

* * * * *